US005615612A

United States Patent [19]

Guba et al.

[11] Patent Number: 5,615,612

[45] Date of Patent: Apr. 1, 1997

[54] APPARATUS FOR THE CLEANING OF CYLINDERS OF A PRINTING MACHINE

[75] Inventors: Reinhold Guba, Weiterstadt; Joachim Olek, Obertshausen; Herbert Schoppe, Neusass, all of Germany

[73] Assignee: MAN Roland Druckmaschinen AG, Germany

[21] Appl. No.: 604,911

[22] Filed: Feb. 23, 1996

[30] Foreign Application Priority Data

Feb. 25, 1995 [DE] Germany ..... 195 06 640.5

[51] Int. Cl.[6] ..... B41F 35/00; B41L 41/00

[52] U.S. Cl. ..... 101/425; 101/423

[58] Field of Search ..... 101/425, 423, 101/424

[56] References Cited

U.S. PATENT DOCUMENTS

| | | | |
|---|---|---|---|
| 3,783,782 | 1/1974 | Hardt | 101/425 |
| 3,845,713 | 11/1974 | Ross et al. | 101/425 |
| 4,344,362 | 8/1982 | Ishii | 101/425 |
| 4,651,644 | 3/1987 | Kaempfe et al. | 101/425 |
| 5,105,740 | 4/1992 | Loos et al. | 101/425 |

FOREIGN PATENT DOCUMENTS

| | | |
|---|---|---|
| 0591634A1 | 7/1993 | European Pat. Off. . |
| 3614542A1 | 11/1987 | Germany . |
| 3744800A1 | 6/1989 | Germany . |
| 9014229 U | 2/1991 | Germany . |
| 4215355A1 | 11/1993 | Germany . |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

An apparatus for cleaning the cylinders of the printing units of a printing machine is disclosed. The cleaning apparatus is provided with three subassemblies. Specifically, it includes a cleaning subassembly having at least one washing roller for washing the cylinder to be cleaned. The cleaning apparatus also includes a conveying subassembly for transporting the cleaning subassembly into and out of the printing unit. The conveying subassembly is dimensioned to slide into the service orifice in the frame of the printing unit while supporting the cleaning subassembly. The cleaning apparatus is also provided with an actuating subassembly mounted on the frame of the printing unit for removably receiving the cleaning subassembly and for selectively moving the cleaning subassembly between a first position wherein the cleaning subassembly is disposed on the conveying subassembly within the service orifice, a second position wherein the cleaning subassembly is separated from the conveying subassembly and displaced laterally from the service orifice, and a third position wherein the at least one washing roller of the cleaning subassembly engages the cylinder to be cleaned.

12 Claims, 3 Drawing Sheets

APPARATUS FOR THE CLEANING OF CYLINDERS OF A PRINTING MACHINE

FIELD OF THE INVENTION

The invention relates generally to printing machines such as sheet-fed offset printing presses, and more particularly to an apparatus for cleaning the cylinders of the printing units of a printing machine.

BACKGROUND OF THE INVENTION

DE 3,614,542 A1 discloses a cleaning apparatus for cleaning a plurality of cylinders within a rotary printing machine. In order to permit the device to be used with several different printing units in a printing machine, the disclosed cleaning apparatus is adapted to be moved in succession from one printing unit to another via a transport device. To this end, the transport device is associated with a guide system. The guide system is provided with a conveyor with an associated drive unit to provide the force for moving the transport device along the guide system from printing unit to printing unit.

The cleaning apparatus disclosed in DE 3,614,542 A1 has several disadvantages. For example, the disclosed apparatus is highly complicated and it takes a considerable amount of time to move the device from one printing unit to the next.

Another device for cleaning the cylinders of a printing machine is known from EP 0,591,634 A1. The device disclosed in EP 0,591,634 A1 can be moved into and out of an orifice formed in a machine frame parallel to the axis of a cylinder to be cleaned. When moved into the orifice, the washing device is received in a suspension device having linear guides. The suspension device possesses end-face connections for the coupling and uncoupling of supply lines such that, when the washing device engages the suspension device, it is automatically connected to the supply lines. After the washing device is coupled to the suspension device, both the suspension device and the washing device can be moved relative to the cylinder to be cleaned by compressed-air cylinders and coupler mechanisms.

The cleaning apparatus disclosed in EP 0,591,634 A1 has several disadvantages. For example, the compressed-air cylinders and the suspension devices considerably restrict the space available for performing servicing work within the orifice, and the linear guides and the coupler mechanism are complicated.

OBJECTS OF THE INVENTION

It is a general object of the invention to provide an improved apparatus for cleaning the cylinders of a printing machine. It is a more specific object of the invention to provide a cleaning apparatus which, when it is installed in a printing unit of a printing machine, does not restrict the free space available for performing servicing work in the servicing orifice of that printing unit. It is a related object to provide a cleaning apparatus which is disposed adjacent to and above the servicing orifice of a printing unit when installed rather than in the orifice to ensure the cleaning apparatus does not impede maintenance work. It is another related object to provide a cleaning apparatus that does not need to be removed from the printing unit during maintenance and other servicing work.

It is another object of the invention to provide an improved cleaning apparatus that can be easily installed in, and removed from, the printing units of a printing machine.

SUMMARY OF THE INVENTION

The present invention achieves these objectives and overcomes the problems associated with the prior art by providing an apparatus for cleaning a cylinder in a printing unit of a printing machine. The apparatus includes a cleaning subassembly having at least one washing roller for washing the cylinder to be cleaned. It also includes a conveying subassembly for transporting the cleaning subassembly into and out of the printing unit. The conveying subassembly is dimensioned to slide into the service orifice in the frame of the printing unit while supporting the cleaning subassembly. The cleaning apparatus is also provided with an actuating subassembly mounted on the frame of the printing unit for removably receiving the cleaning subassembly and for selectively moving the cleaning subassembly between a first position wherein the cleaning subassembly is disposed on the conveying subassembly within the service orifice, a second position wherein the cleaning subassembly is separated from the conveying subassembly and displaced laterally from the service orifice, and a third position wherein the at least one washing roller of the cleaning subassembly engages the cylinder to be cleaned.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
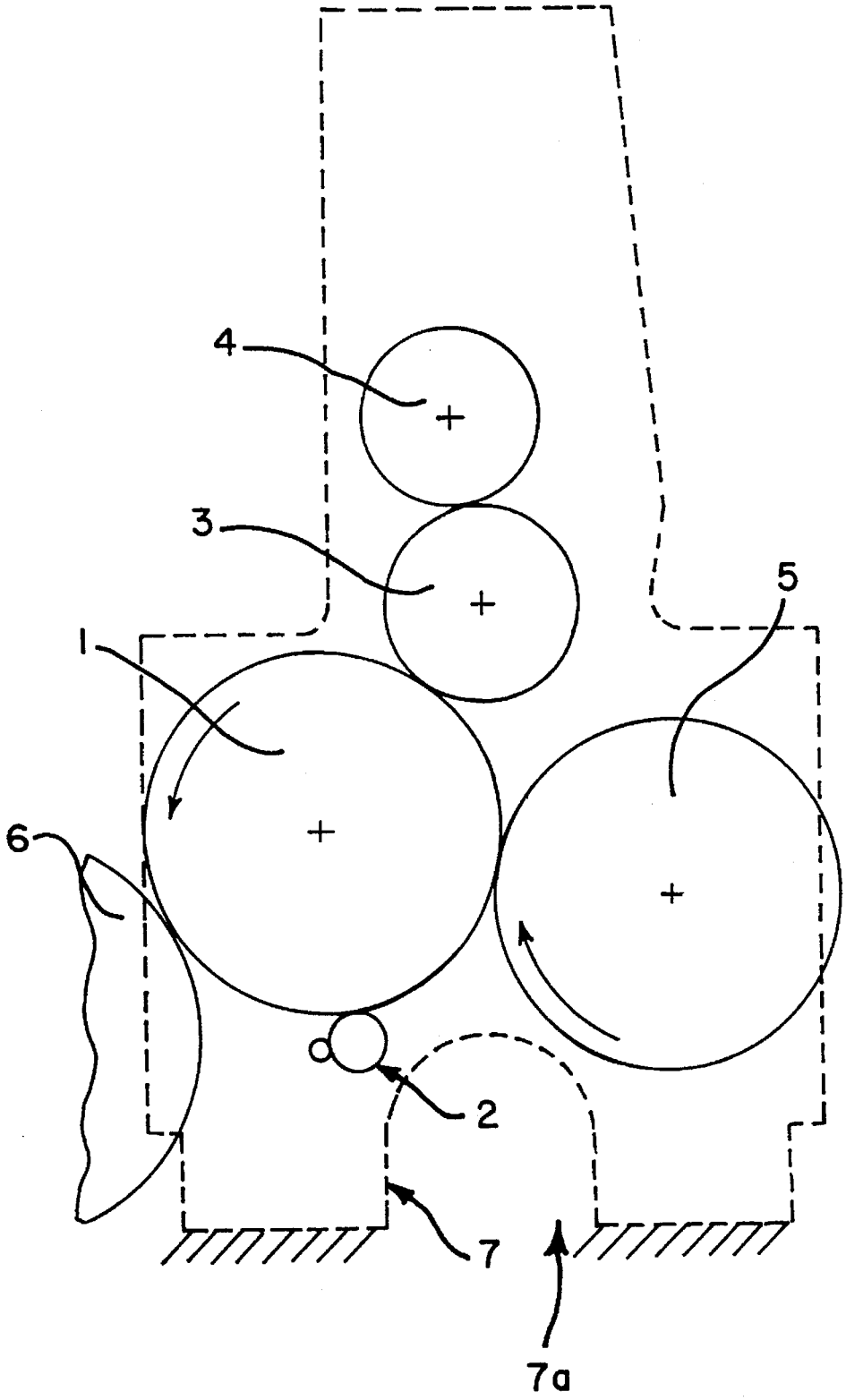
FIG. 1 diagrammatically illustrates a cleaning apparatus constructed in accordance with the teachings of the invention and coupled to a printing unit of a representative sheet-fed offset printing machine.

A typical sheet-fed offset printing machine includes several printing units such as the unit illustrated in FIG. 1 connected in succession. Thus, although the following discussion will primarily focus on a single printing unit, it will be understood that the discussion is equally applicable to each printing unit of the printing machine.

Each printing unit of a typical sheet-fed offset printing machine includes a printing cylinder 1, which acts as an impression cylinder, an adjacent rubber-blanket cylinder 3 and a plate cylinder 4 assigned to the rubber-blanket cylinder 3; all of which are operatively connected as shown in FIG. 1. In order to transport paper to and from the printing cylinder 1, the printing cylinder 1 is preceded in the sheet running direction by a first transfer drum 5 and followed by a second transfer drum 6. All of these cylinders are supported at their ends, either directly or indirectly, by a laterally arranged machine frame 7.

For the purpose of providing access to the cylinders of the printing unit for maintenance and the like, the frame 7 defines a servicing orifice **7*a* which runs generally parallel to the longitudinal axes of the cylinders. As those skilled in the art will appreciate, this servicing orifice 7*a* has traditionally been used as a "man-hole" to permit maintenance personnel to access the cylinders of the printing unit for servicing work. The cleaning apparatus of the present invention takes advantage of the access to the cylinders of the printing units provided by these man-holes 7***a* and, as explained in detail below, is installed and removed from the individual printing units of the printing machine via these orifices 7*a*.

The cleaning apparatus of the present invention is provided with three separate subassemblies, namely, an actuating subassembly 12, a cleaning subassembly 2, and a conveying subassembly 10. The conveying subassembly 10 serves to transport the cleaning subassembly 2 from place to place; the cleaning subassembly 2 actually cleans the cylinders of the printing unit it serves; and the actuating subassembly 12 serves to move the cleaning assembly 2 from the conveying subassembly 10 into contact with the cylinder to be cleaned and vice versa.

As mentioned above, in order to facilitate both the installation and removal of the cleaning subassembly 2 within the servicing orifice 7*a* of a given printing unit and to provide a means for transporting the cleaning subassembly 2 from one printing unit to the next, the cleaning device is provided with a conveying subassembly 10. In the preferred embodiment, the conveying subassembly 10 is implemented by a floor conveyor 8 which comprises a basic framework with mountings for receiving and supporting the cleaning subassembly 2. The floor conveyor 8 is provided with a plurality of steering rollers 18 which facilitate both moving the cleaning subassembly 2 into and out of the service orifices 7*a* of the individual printing units and moving the cleaning subassembly 2 from one printing unit to another. The floor conveyor 8 is dimensioned to fit within the servicing orifice 7*a* of a printing unit when supporting the cleaning subassembly 2.

To facilitate movement of the floor conveyor 8 into and out of the service orifices 7*a*, the service orifice 7*a* of each printing unit on a serviced printing machine is preferably provided with transverse guides 9 mounted on the machine frame 7 and extending parallel to the axis of the cylinder 1. The transverse guides 9 are preferably provided with run-on slopes on the open side of the frame 7. These slopes serve to guide the floor conveyor 8 into the service orifice 7*a* thereby facilitating the insertion of the conveying subassembly 10 into the printing unit.

To further facilitate the insertion process and to locate the floor conveyor 8 relative to the orifice 7*a*, the floor conveyor 8 is preferable provided with centering rollers 17 rotatably mounted to engage the transverse guides 9. The engagement of the centering rollers 17 and the transverse guides 9 ensures that the floor conveyor 8 and the cleaning subassembly 2 it carries are located in substantially the same position relative to the frame 7 every time they are inserted into the service orifice 7*a*.

Although in the preferred embodiment, the conveying subassembly 10 is implemented by a wheeled floor conveyor 8 designed to be manually rolled along the floor, those skilled in the art will appreciate that other conveyors could likewise be employed in this role without departing from the scope or the spirit of the claimed invention. For example, instead of being manually moved from place to place, the floor conveyor 8 could be provided with a drive system such as an electric motor to provide powered movement. Alternatively, the conveying subassembly 10 could be implemented by a conveyor designed for movement on an air cushion or by means of guide devices arranged, for example, on the floor.

For the purpose of washing the cylinder to be cleaned with a suitable cleaning solution, the cleaning device is provided with a cleaning subassembly 2. In the preferred embodiment, this cleaning subassembly 2 includes washing rollers 30 which rotate against the cylinder to be cleaned. As will be appreciated by those skilled in the art, these washing rollers 30 can be implemented in many ways without departing from the scope or the spirit of the invention. For example, the washing rollers 30 can be implemented as washing brushes with an assigned wiper, or as a washing cloth with an assigned pressure element. In any event, the washing rollers or spindles are preferably journalled in sidewalls arranged on opposite end faces of a housing 32. With the exception of one open side positioned to permit the washing rollers 30 to contact the cylinder to be cleaned (in the illustrated embodiment, plate cylinder 1), the housing 32 preferably substantially surrounds the rollers 30.

To supply the washing rollers 30 with cleaning solutions and energy, the housing 32 preferably includes one or more nozzles (not shown) for supplying a washing agent and/or water, and a connection (also not shown) for supplying electrical power to the cleaning subassembly 2. The nozzles are assigned to the washing rollers 30 in a manner well known in the art. A roller drive (not shown), such as an electric motor, for rotating the washing rollers 30 is likewise preferably arranged in the housing 32, so that the cleaning subassembly 2 comprises a complete cleaning unit including the connections for water, washing agent and energy.

Figure 2:
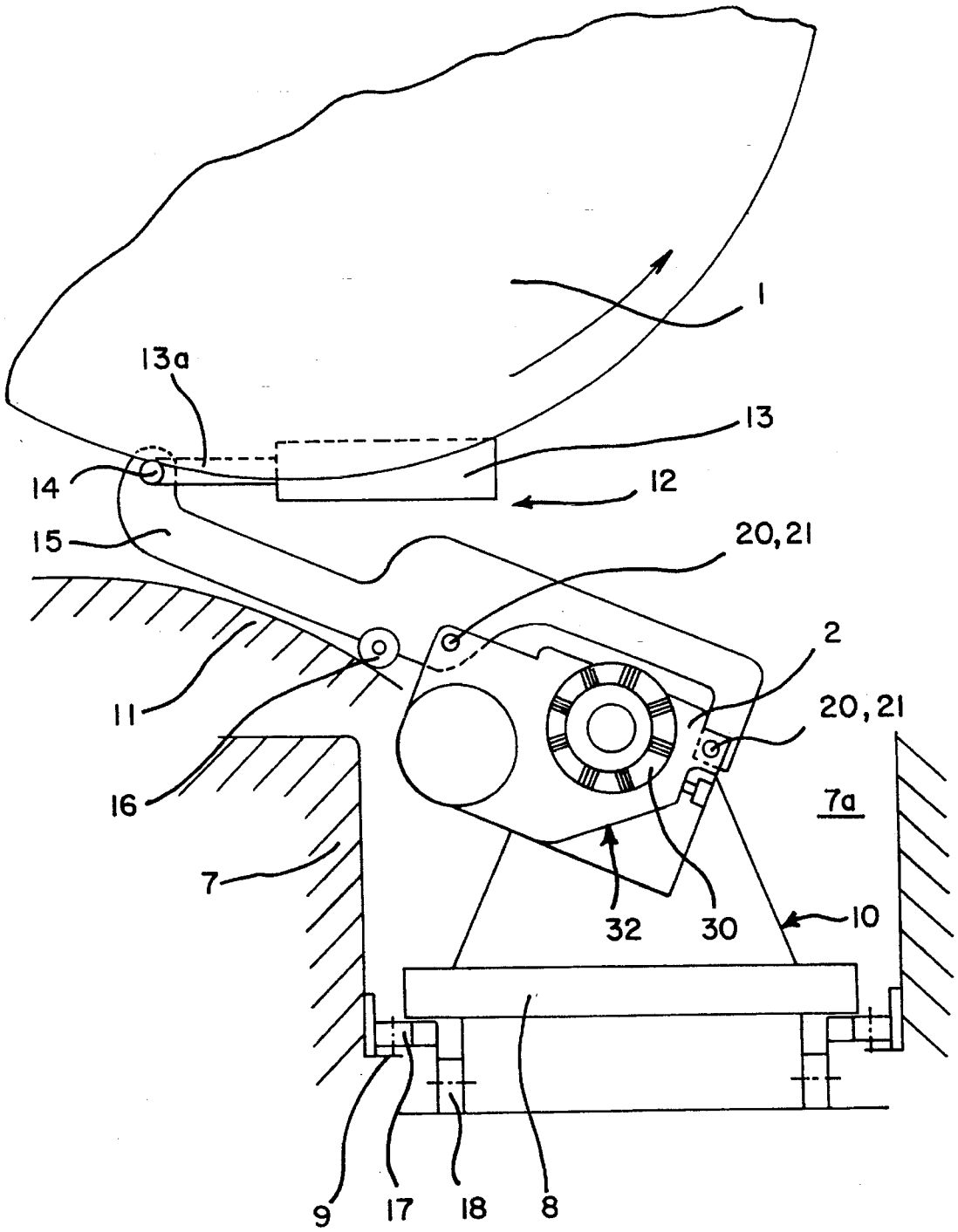
FIG. 2 more specifically illustrates the cleaning apparatus of FIG. 1 disposed in the servicing orifice during installation or removal of the cleaning apparatus from the printing unit; and, FIG. 3 is a view similar to FIG. 2 but showing the cleaning device pivoted to the position of readiness outside of the service orifice of the printing unit.
Figure 3:
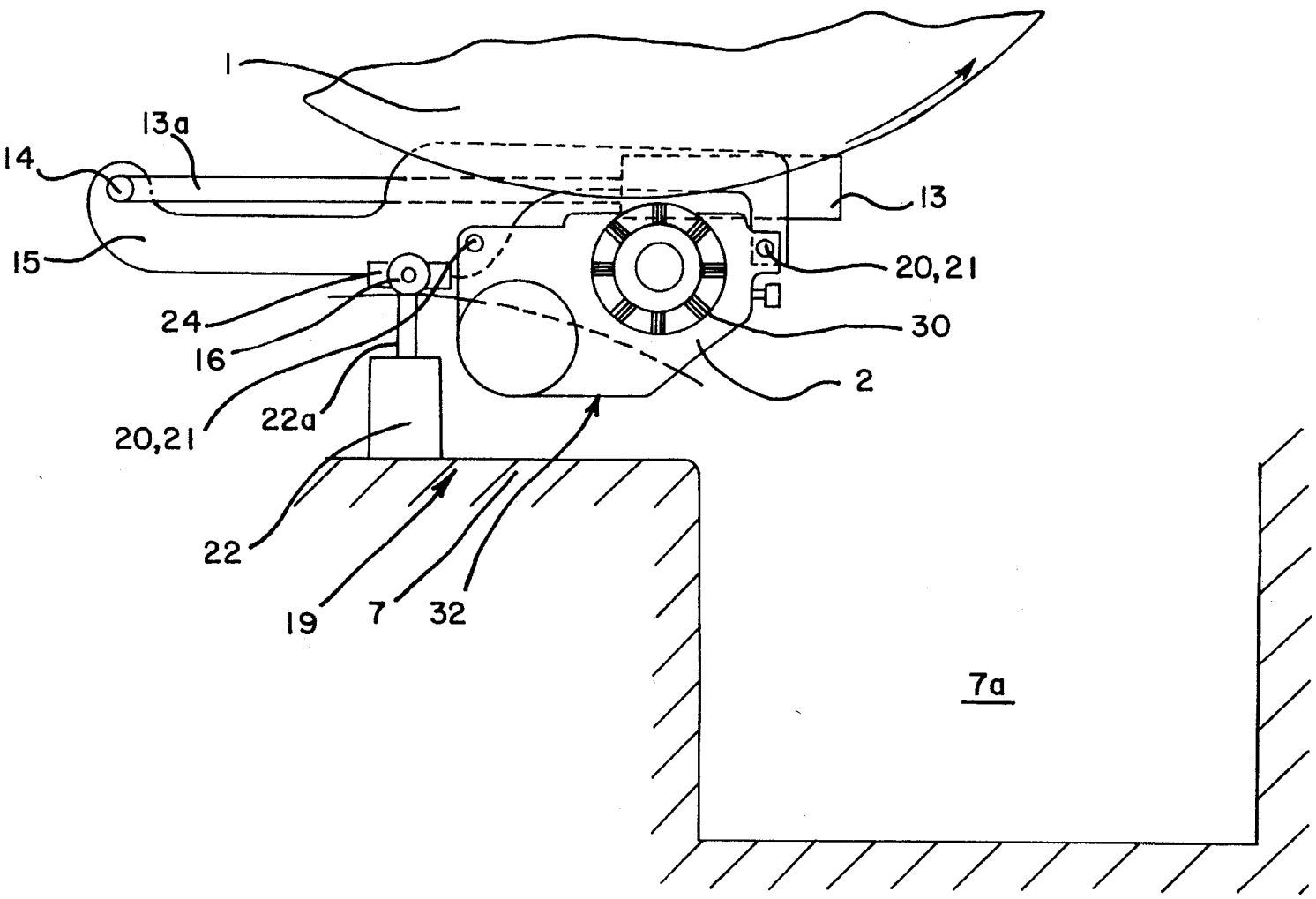

In accordance with an important aspect of the invention, no part of the cleaning apparatus remains within the servicing orifice after the cleaning device is installed on a printing unit. To this end, the cleaning apparatus is provided with means for moving the cleaning subassembly 2 from the conveying subassembly 10 laterally out of the servicing orifice 7*a* and into contact with the cylinder to be cleaned thereby leaving the servicing orifice 7*a* substantially unimpeded for maintenance work. In the illustrated embodiment, the means for moving the cleaning subassembly 2 comprises the actuating subassembly 12. Although those skilled in the art will appreciate that the actuating subassembly 12 could be implemented in numerous ways without departing from the scope or the spirit of the invention, the illustrated actuating subassembly 12 is implemented by two substantially identical levers 15 each of which is pivotably mounted to an extendible piston rod 13*a* of a working cylinder 13 disposed at opposite ends of the frame 7 underneath the cylinder to be cleaned. Each of the levers 15 is rotatably coupled to its respective rod 13*a* via a rotary joint 14 as shown in FIGS. 2 and 3.

In order to removably couple the cleaning subassembly 2 to the actuating subassembly 12, each lever 15 of the actuating subassembly 12 has centering devices 20 for engaging centering means 21 disposed on the housing 32 of the cleaning subassembly 2. Although, as those skilled in the art will readily appreciate, the centering devices 20 of the levers 15 and the centering means 21 of the cleaning subassembly 2 could be implemented in any of a number of ways known in the art, in the illustrated embodiment the centering devices 20 comprise bores formed in the levers 15 and the centering means 20 comprise posts which, when the cleaning subassembly 2 is fully inserted into the servicing orifice 7*a* of a given printing unit, mate with the corresponding bores in the levers 15. In other words, as the cleaning subassembly 2 is inserted into the servicing orifice 7*a*, the posts of the cleaning subassembly 2 mate with the bores defined in the levers 15 on the conveying subassembly 12 to provide a secure attachment therebetween. Once this engagement is complete, the working cylinder 13 can be actuated to lift the cleaning subassembly 2 off of the conveying subassembly 10 and out of the servicing orifice 7*a*. After the cleaning subassembly 2 is removed from the conveying subassembly 10, the conveying subassembly can be freely moved out of the orifice 7*a* to transport other cleaning subassemblies 2 to other printing units thereby leaving the servicing orifice 7*a* of the original printing unit open for maintenance work.

For the purpose of controlling the lateral movement of the cleaning subassembly 2 relative to the cylinder to be cleaned, the actuating subassembly 12 is provided with a lateral guide 11 fixedly mounted on each end of the frame 7 and a cam roller 16 mounted on each of the levers 15. As illustrated in FIGS. 2 and 3, the cam rollers 16 roll along the cam surface of their corresponding guides 11 as the working cylinders 13 extend and/or retract their corresponding rods 13*a* between a retracted position (shown in FIG. 2) and an extended position (shown in FIG. 3). Since the lateral guides 11 have a curvilinear profile disposed at a gradually decreasing, upwardly inclined angle, the interaction of the cam rollers 16 and the guides 11 forces the levers 15 to pivot upwards about rotary joint 14 as the working cylinders 13 extend their rods 13*a* from the retracted position to the extended position. As a result, the cleaning subassembly 2 is lifted off of the conveying subassembly 10 and out of the servicing orifice 7*a* to the "position of readiness" shown in FIG. 3. Since the cleaning subassembly 2 is removed from the servicing orifice 7*a*, it can remain in this "position of readiness" for extended periods of time without adversely effecting the operation or maintenance of the serviced printing unit. The connections for washing agent, water and energy associated with the cleaning subassembly 2 are automatically coupled in a known way to corresponding supply connections when the cleaning subassembly 2 enters the "position of readiness" such that the cleaning subassembly 2 is connected to all the necessary supply lines.

In order to move the cleaning subassembly 2 from the position of readiness into engagement with the cylinder to be cleaned, the actuating subassembly 12 is provided with a lifting cylinder 22 fixedly mounted on the frame 7 underneath the cylinder to be cleaned. This lifting cylinder 22 includes an extendible rod 22*a* which removably engages a crossmember 24 arranged on the housing 32 of the cleaning subassembly 2 to selectively force the cleaning subassembly 2 upwards into contact with the cylinder to be cleaned. More specifically, as the lifting cylinder 22 extends its rod 22*a*, the cleaning subassembly 2 is forced upwards such that the levers 15 pivot about their rotary joints 14 and the washing rollers 30 engage the cylinder to be cleaned.

In operation, the cleaning subassembly 2 is first positioned on the floor conveyor 8. The floor conveyor 8 is then rolled into the service orifice 7*a* of the machine frame 7 of the printing unit to be serviced. This insertion is facilitated by the interaction of the centering rollers 17 disposed on the floor conveyor 8 and the transverse guides 9 fixed to the frame 7. The floor conveyor 8 is inserted into the orifice 7*a* until the centering means 21 of the cleaning subassembly 2 engage the centering devices 20 of the levers 15. When coupling occurs between the centering devices 20 and the centering means 21, the "push-in position" is obtained.

The working cylinders 13 then move the cleaning device 2 laterally along the lateral guides 11 by extending their rods 13*a* from the retracted position to the extended position. As the cam rollers 16 of the levers 15 run along the lateral guides 11, the cleaning subassembly 2 is lifted off of the floor conveyor 8 and displaced laterally from the service orifice 7*a*. The floor conveyor 8, thus, becomes free and can be removed from the printing unit to, for example, receive another cleaning subassembly 2 to service another printing unit in the printing machine.

The working cylinders 13 of the actuating subassembly 12 are activated until the cleaning subassembly 2 has reached the position of readiness. In other words, the working cylinders 13 extend their rods 13*a* a predetermined distance to position the levers 15 and the cleaning subassembly 2 in a predetermined location. The cleaning device 2 is held in this predetermined location (i.e., the position of readiness) by the actuating cylinders 13. In this position, the cleaning subassembly 2 is automatically coupled to the connections for water, washing agent and energy.

If the user wishes to employ the cleaning subassembly 2 to clean the printing cylinder 1, the lifting cylinder 22 is activated. The lifting cylinder 22 then lifts the cleaning subassembly 2 via the crossmember 24 by pivoting the lever 15 and the housing 32 about the rotary joint 14 until the cleaning subassembly 2 engages the printing cylinder 1. The printing cylinder 1 can then be washed in a known way.

After the cleaning operation is completed, the rod 22*a* of the working cylinder 22 is retracted and the cleaning subassembly 2 is thus lowered into the position of readiness. If the cleaning subassembly 2 is to be exchanged, for example for servicing purposes, it is moved out of the position of readiness shown in FIG. 3 to the push-in position shown in FIG. 2 by retracting the first working cylinder 13 such that the cam rollers 16 move back down the lateral guides 11 and the levers 15 pivot downwards about their rotary joints 14. Once this pivoting operation is complete and the cleaning subassembly 2 is set down onto a waiting floor conveyor 8, the floor conveyor 8 can then be moved out of the orifice 7*a* in the machine frame 7. The removed cleaning subassembly 2 can then be easily moved to a another location for maintenance or the like. Alternatively, the removed cleaning subassembly 2 could be moved to another printing unit via the floor conveyor 8 and used to clean that other printing unit. Thus, it will be appreciated that only one floor conveyor 8 is required for cleaning all of the printing units within a printing machine. It will further be appreciated that each printing unit to be serviced by the inventive cleaning apparatus should be provided with its own actuating subassembly 12. Depending upon the preferences of the end user, any number of cleaning subassemblies 2 could be employed.

Those skilled in the art will further appreciate that, although the actuating subassembly 12 has been implemented in part via a working cylinder 13 in the illustrated embodiment, other approaches could be employed without departing from the scope or the spirit of the invention. For example, the working cylinder 13 could be replaced by a drive motor which utilizes a rope and pulley system in cooperation with the lateral guides 11 to move the cleaning subassembly 2 off of the conveying subassembly 10 and into the position of readiness. Alternatively, rather than employing two separate working cylinders 13 as shown in the illustrated embodiment, the actuating subassembly 12 could be implemented with a single working cylinder 13 without departing from the scope or the spirit of the invention. If, however two cylinders are employed, those skilled in the art will appreciate that they should be operated synchronously to ensure smooth operation and proper orientation of the cleaning device.

Finally, those skilled in the art will appreciate that, although the inventive cleaning device could be used to clean other cylinders in a printing press, the inventive cleaning device is particularly well suited for cleaning impression cylinders in printing machines. Specifically, it is difficult to manually position a cleaning device in the proximity of these cylinders because their geometrical arrangement makes access to the impression cylinders difficult and because, in the case of sheet-fed printing machines of a higher format class, the required cleaning subassembly has a relatively high mass. Accordingly, it is highly advantageous to use the inventive cleaning apparatus to clean impression cylinders.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. An apparatus for cleaning a cylinder in a printing unit of a printing machine, the printing unit including a frame defining a service orifice to provide access to the cylinder, the apparatus comprising:

a cleaning subassembly including at least one washing roller for washing the cylinder to be cleaned;

a conveying subassembly for transporting the cleaning subassembly into and out of the printing unit, the conveying subassembly being dimensioned to slide into the service orifice in the frame of the printing unit while supporting the cleaning subassembly; and, an actuating subassembly mounted on the frame of the printing unit for removably receiving the cleaning subassembly and for selectively moving the cleaning subassembly between a first position wherein the cleaning subassembly is disposed on the conveying subassembly within the service orifice, a second position wherein the cleaning subassembly is separated from the conveying subassembly and displaced laterally from the service orifice, and a third position wherein the at least one washing roller of the cleaning subassembly engages the cylinder to be cleaned.

2. An apparatus as defined in claim 1 wherein the conveying subassembly comprises a wheeled floor conveyor.

3. An apparatus as defined in claim 2 further comprising transverse guides mounted on the frame within the service orifice for guiding the wheeled floor conveyor into the service orifice.

4. An apparatus as defined in claim 3 wherein the wheeled floor conveyor includes centering rollers rotatably mounted to engage the transverse guides to locate the floor conveyor relative to the service orifice.

5. An apparatus as defined in claim 1 wherein the actuating assembly further comprises:

a first working cylinder mounted on the frame of the printing unit, the first working cylinder having an extendible rod movable between a retracted position and an extended position;

a first lever rotatably coupled to an end of the extendible rod of the first working cylinder, the first rotatable lever including means for removably receiving the cleaning subassembly;

a first cam roller mounted on the first lever; and, a first lateral guide fixed to the frame of the printing machine and having a cam surface in operative engagement with the first cam roller, the cam surface being disposed at an upwardly inclined angle such that as the first working cylinder extends the extendible rod from the retracted position to the extended position, the first cam roller rolls up the cam surface and the first lever pivots about the end of the rod to move the cleaning subassembly from the first position to the second position.

6. An apparatus as defined in claim 5 wherein the means for removably receiving the cleaning subassembly associated with the first lever comprises at least one bore defined in the first lever and at least one post disposed on the cleaning subassembly for mating with the at least one bore.

7. An apparatus as defined in claim 5 wherein the actuating subassembly further comprises a lifting cylinder with an extendible rod for selectively applying a lifting force to the cleaning subassembly to move the cleaning subassembly from the second position to the third position.

8. An apparatus as defined in claim 7 wherein the lifting cylinder selectively engages a crossmember disposed on the cleaning subassembly to apply the lifting force.

9. An apparatus as defined in claim 5 wherein the actuating assembly further comprises:

a second working cylinder mounted on the frame of the printing unit opposite the first working cylinder, the second working cylinder having an extendible rod movable between a retracted position and an extended position;

a second lever rotatably coupled to an end of the extendible rod of the second working cylinder, the second rotatable lever including means for removably receiving the cleaning subassembly;

a second cam roller mounted on the second lever; and, a second lateral guide fixed to the frame of the printing machine and having a cam surface in operative engagement with the second cam roller, the cam surface of the second lateral guide being disposed at an upwardly inclined angle such that as the second working cylinder extends the extendible rod from the retracted position to the extended position, the second cam roller rolls up the cam surface and the second lever pivots about the end of the rod to move the cleaning subassembly from the first position to the second position.

10. An apparatus as defined in claim 9 wherein the means for removably receiving the cleaning subassembly associated with the second lever comprises at least one bore defined in the second lever and at least one post disposed on the cleaning subassembly for mating with the at least one bore of the second lever.

11. An apparatus as defined in claim 9 wherein the actuating subassembly further comprises a lifting cylinder with an extendible rod for selectively applying a lifting force to the cleaning subassembly to move the cleaning subassembly from the second position to the third position.

12. An apparatus as defined in claim 11 wherein the lifting cylinder selectively engages a crossmember disposed on the cleaning subassembly to apply the lifting force.

* * * * *